United States Patent [19]

Clarke et al.

[11] Patent Number: 4,604,954

[45] Date of Patent: Aug. 12, 1986

[54] TELESCOPED AMMUNITION WITH DUAL SPLIT CARTRIDGE CASE

[75] Inventors: Stephen E. Clarke, Orange; James D. Hendry, Huntington Beach; Ernest R. Mijares, Sunset Beach, all of Calif.

[73] Assignee: Ford Aerospace & Communications Corp., Dearborn, Mich.

[21] Appl. No.: 663,645

[22] Filed: Oct. 22, 1984

[51] Int. Cl.[4] ..... F42B 5/02

[52] U.S. Cl. ..... 102/434; 102/464

[58] Field of Search ..... 102/430, 433, 436, 434, 102/443, 464–468

[56] References Cited

U.S. PATENT DOCUMENTS

| | | | |
|---|---|---|---|
| 2,866,412 | 12/1958 | Meyer et al. | 102/434 |
| 3,892,181 | 7/1975 | Goldin . | |
| 4,335,657 | 6/1982 | Bains | 102/433 |

*Primary Examiner*—Harold J. Tudor

*Attorney, Agent, or Firm*—Peter Abolins; Keith L. Zerschling

[57] ABSTRACT

A telescoped ammunition round has a projectile positioned in the axial cavity of a propellant charge. A generally tubular casing surrounding the propellant charge has two longitudinal splits dividing the casing into two substantially identical halves which can separate during firing and sustain the pressure created by the propellant charge without deforming. An end cap assembly couples adjacent ends of the halves of the tubular casing to each other.

10 Claims, 5 Drawing Figures

TELESCOPED AMMUNITION WITH DUAL SPLIT CARTRIDGE CASE

BACKGROUND OF THE INVENTION

1. Technical Field

This invention relates to a structure for improving the ballistic performance of a telescoped ammunition round.

2. Background Art

Telescoped ammunition includes a propellant charge having an axial bore or cavity, a projectile housed entirely within the axial bore of the propellant charge and a case around the propellant charge. When a telescoped round of ammunition is loaded into the chamber of the gun, the projectile, being housed in a propellant charge, is not seated in the barrel of the gun as is the projectile of a round of conventional ammunition when in a gun chamber. When the telescoped round is fired, the projectile is forced forward into the barrel of the gun and becomes seated in the barrel. The firing force is also applied as an outward force to the case and may cause deformation or deflection of the case. After firing, it is desired to remove the remaining portions of the ammunition round from the gun chamber. Any resulting interference between the case and the chamber to such removal is undesirable.

It is known that a solid tubular steel case may lock in the chamber during firing and thus cannot be used when it is desired to have multiple firings of telescoped ammunition. It is also known to use a plastic case in an automatic fixture for telescoped ammunition. However, plastic is not capable of handling the ballistic cycle loads throughout a typical firing environmental temperature range of −65° F. to +165° F. without failing.

Further, it is known to fabricate a case from two sections which are then bonded together. For example, U.S. Pat. No. 3,892,181 issued to Goldin teaches a flat telescoped cartridge case which is formed of two separate, identical pieces which are joined by ultrasonic welding. As a result, such a fabricated case has the same disadvantages as a single piece case in that it may deform.

A single piece case with a single split is also known. Such a case can be extracted rearwardly from the chamber. However, the firing of the ammunition round may cause sufficient deflection and subsequent deformation of the case so as to prevent rapid and easy removal of the case. Such quick removal is a very desirable feature in a rapid fire system with automatic loading and unloading.

It would be desirable to develop a case which can operate over a wide temperature range without failure, does not deform during firing and can be reused. These are some of the problems this invention overcomes.

DISCLOSURE OF THE INVENTION

This invention teaches a telescoped ammunition round having a propellant charge, a generally tubular casing having two longitudinal splits and two end cap means for coupling the two portions of the casing together. The propellant charge has an axial cavity and supplies firing power for the ammunition round. A projectile is housed within the cavity and is fired from the ammunition round. The tubular casing generally surrounds the propellant charge and has two longitudinal splits dividing the casing into two substantially identical halves which can separate during firing and sustain the pressure created by the propellant charge without deforming. The end cap means couple adjacent ends of the halves of the tubular casing to each other.

A split steel case in accordance with an embodiment of this invention is strong enough to accommodate attachment of the end seals without degrading its handling and ballistic performance capability. The dual split case design makes it possible to easily assemble the round while accommodating a seal attachment flange on the case. That is, the case can be clamped around the internal components during assembly. It is not possible to incorporate an attachment flange into a straight single piece cylinder case and retain such an easy assembly feature. Further, the simple geometry of the case halves is readily adaptable to an easy, relatively low-cost method of manufacture. The method used to manufacture a one-piece cartridge case and assemble a telescoped ammunition round having a one-piece cartridge case is more complex and expensive. Further, lower strength and lower cost materials can be used for the split case design in comparison to a single piece case.

BEST MODE FOR CARRYING OUT THE INVENTION

Figure 1:
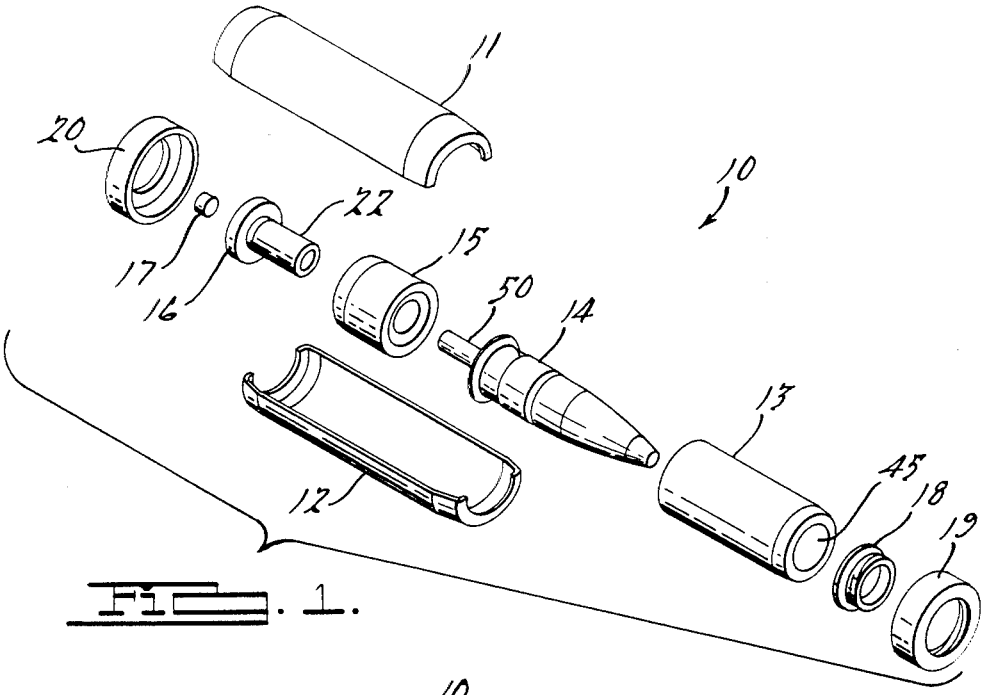
FIG. 1 is an exploded perspective view of an ammunition round in accordance with an embodiment of this invention.

Referring to FIG. 1, an ammunition round 10 includes a first split case half 11 and a second split case half 12 which together form a generally cylindrical case with a axial opening for receiving a propellant 13 having a generally tubular configuration with a central axial opening. The central axial cavity of propellant 13 receives a projectile assembly 14, a rear grain propellant 15, a rear retainer 16, and a primer 17. A front retainer 18 is coupled to propellant 13. A front seal 19 and a rear seal 20 are coupled to split case halves 11 and 12.

Figure 2:
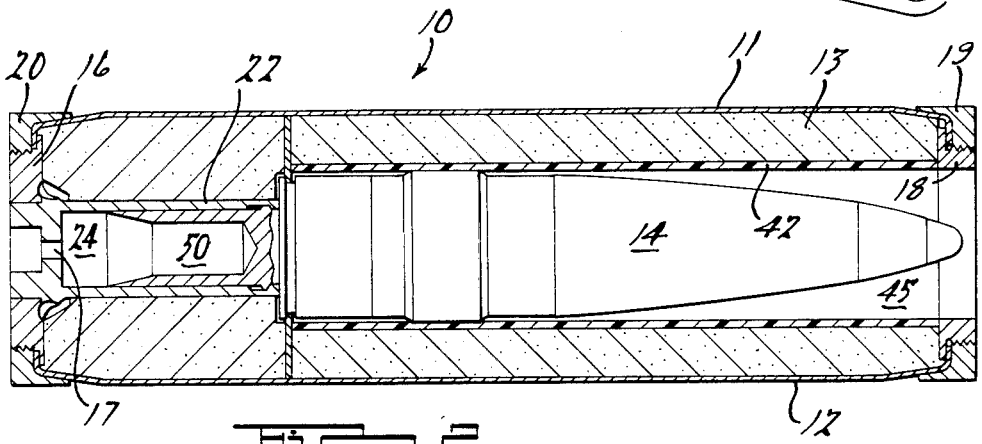
FIG. 2 is a section view of an ammunition round in accordance with an embodiment of this invention.
Figure 3:
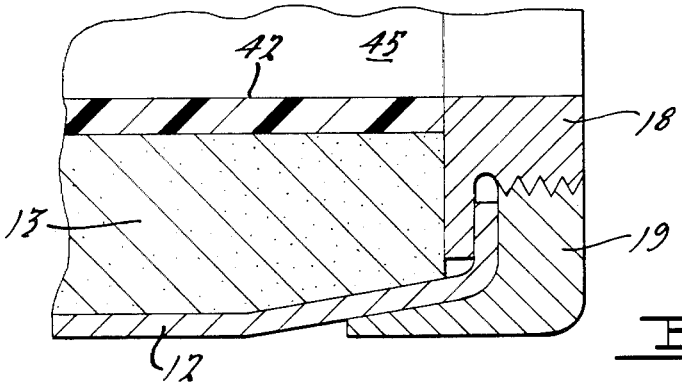
FIG. 3 is an enlarged portion of the section view of FIG. 2, in accordance with an embodiment of this invention.

Referring to FIGS. 2 and 3, split case halves 11 and 12 are mirror images of one another and are identical halves of an assembled case. Case halves 11 and 12 are thin walled steel cartridges and form a right circular cylinder. The inside surface of case halves 11 and 12 is coated with a paint material to provide a heat barrier and further eliminate case distortion during firing. The two halves nest and are adaptable to automated lines for high production rates. In component form, the cartridge case consumes less volume since the halves can be nested.

Both forward and aft annular seals 19 and 20 are interchangeable and have an "L" shaped cross section with a threaded area on the smallest diameter. A flange on front and rear retainers 16 and 18 is placed on the inside of the case and seals 19 and 20 are screwed onto retainers 18 and 16, respectively, so as to lock case halves 11 and 12 in place. The flanges on front and rear retainers 16 and 18 provide the axial and radial support for case halves 11 and 12 and provide control of overall cartridge length and diameter. Aft retainer 16 is also integrally coupled to a control tube 22. Front retainer 18 is ring-shaped. Retainers 18 and 16 have externally threaded ends to mate with the threads on seals 19 and 20.

Referring to FIG. 2, ammunition cartridge 10 includes a generally cylindrical main propellant charge 13 having a cylindrical, coaxial cavity 45 wherein is positioned a generally elongated, tapered projectile 14. Positioned aft of projectile 14 is a generally cylindrical piston 50 having a longitudinal axis aligned with the longitudinal axis of axial cavity 45. A recess in the aft face of piston 50 contains a booster charge 24 for propelling piston 50 forward within axial cavity 45 which also causes corresponding forward motion of projectile 14 within axial cavity 45. A primer charge 17 is positioned aft of booster charge 24. Control tube 22 is a generally cylindrical, hollow sheath which surrounds primer charge 17, booster charge 24 and a rearward portion of projectile 14. Control tube 22 is sized to fit snuggedly within axial cavity 45 of main propellant charge 13. Firing of primer charge 17 and booster charge 24 causes piston 50 to move forward and expose main propellant charge 13 to firing.

Performance repeatability in telescoped ammunition is achieved by physically separating the initial projectile acceleration and main propellant ignition function. Control tube 22 launches and guides projectile 14 toward the barrel of a firing gun and contains and confines the initial firing of primer charge 17 and booster charge 24 so that the start of the firing sequence occurs at a fixed volume thus increasing the impetus to projectile 14. After initial projectile acceleration, the ignition of main propellant charge 13 when piston 50 has moved sufficiently forward within axial cavity 45. Thus, main propellant charge 13 fires solely as a function of the forward travel position of piston 50.

Main propellant charge 13 is bounded by a cylindrical hollow outer case halves 11 and 12 on the outside cylindrical surface and an inner case 42 on the inside cylindrical surface around a forward portion of axial cavity 45. Inner case 42 extends from the front of main propellant charge 13 aft along a portion of the length of projectile 14. The aft end of main propellant charge 13 between the control tube 22 and outer case halves 11 and 12 is sealed by a generally annular rear seal 20. Similarly, the forward end of main propellant charge 13 between inner case 42 and outer case halves 11 and 12 is closed by a generally annular front seal 19.

The firing sequence of ammunition cartridge 10 includes the firing of primer charge 17 by such means as a firing pin or an electric spark so that heat and shock waves are transmitted to a booster charge adjacent piston 50 which then ignites. This causes a pressure build up aft of piston 50. At a predetermined pressure, there is forward movement of piston 50 in a direction parallel to the axis of axial cavity 45 as guided by control tube 22. As a result of such forward movement of piston 50 there is also forward movement of projectile 14. As projectile 14 leaves ammunition cartridge 10, it enters the barrel of a firing gun and there is a snug fit, well known in the art, between the outer surface of the projectile and the inner surface of the barrel so that the hot combustion gases caused by the firing of ammunition cartridge 10 further propel projectile 14 out of the barrel. This staged sequence of ignition provides an energetic, fast and reproducible ignition of main propellant charge 13 controlled by the precise positioning of the projectile during the initial boost phase.

When ammunition round 10 is placed in the chamber of a gun, the double split cartridge permits the cartridge case to deflect to sustain the firing pressure without deforming. Since the case is not deformed, it is readily removable from the chamber after completion of the ballistic cycle. This action permits use of an ammunition round in accordance with an embodiment of this invention in automatic multifire telescoped ammunition guns.

Figure 4:
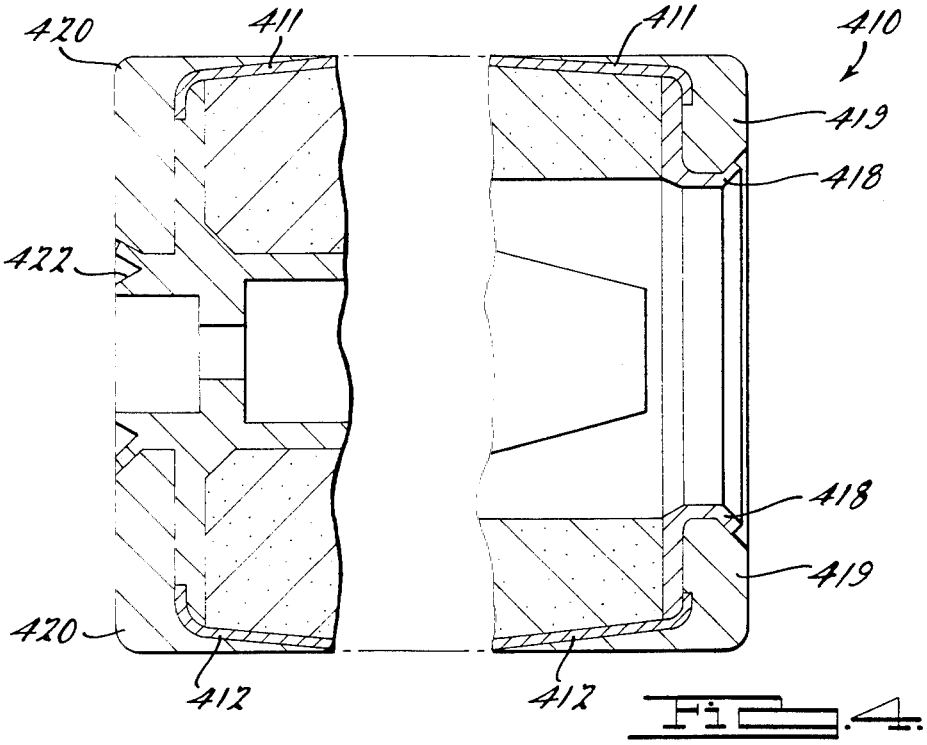
FIG. 4 is a section view of an ammunition round in accordance with an embodiment of this invention having a swagged retention of an end cap seal.

Referring to FIG. 4, an ammunition round 410 uses a swagged retainer for securing an end cap for ammunition round 410. Split case halves 411 and 412 each have a front portion curving around an annular or front retainer 418. Front retainer 418 extends and curves around the interior edge of an annular front seal 419. Similarly, split case halves 411 and 412 each have a rear portion curving around an annular flange of a control tube 422. In turn, control tube 422 extends and curves around the interior edge of an annular rear seal 420. This construction secures front and rear seals 419 and 420 to split case halves 411 and 412.

Figure 5:
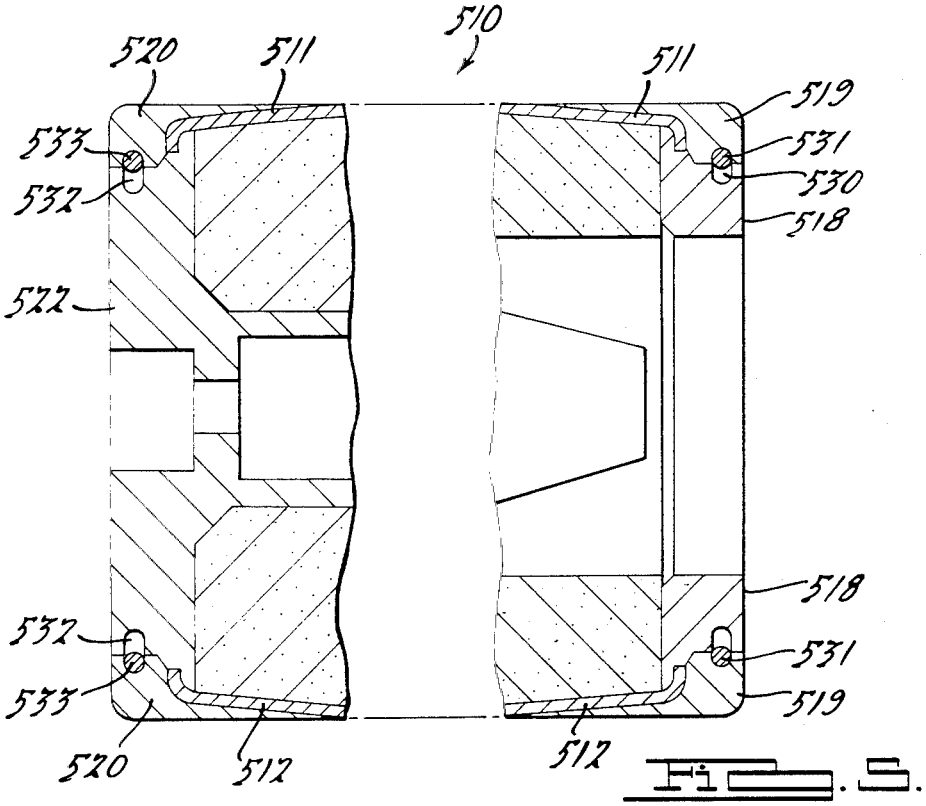
FIG. 5 is a section view of an ammunition round in accordance with an embodiment of this invention having a snap ring retention of an end cap seal.

Referring to FIG. 5, an ammunition round 510 uses a snap ring retainer for securing an end cap for ammunition round 510. Split case halves 511 and 512 each have a front portion curving around an annular front retainer 518. Front retainer 518 and an annular front seal 519 have aligned annular openings 530. A snap ring spring 531 can be deflected into one part of opening 530 while front retainer 518 and front seal 419 are positioned adjacent each other. When annular openings 530 are axially aligned, snap spring 531 assumes an undeflected position in openings 530 so that there is interference to axial movement of front seal 519 with respect to front retainer 518. Similarly, split case halves 511 and 512 each have a rear portion curving around an annular flange of a control tube 522. Control tube 522 and an annular rear seal 520 have aligned annular openings 532. A snap ring 533 can be deflected into one part of openings 532 while rear retainer 520 and control tube 522 are positioned adjacent each other. When annular openings 532 are axially aligned, snap ring spring 533 assumes an undeflected position in openings 532 so that there is interference to axial movement of rear seal 520 with respect to control tube 522. This construction secures front and rear seals 519 and 520 to split case halves 511 and 512. The particular construction of the snap ring spring and receiving openings can be such that the ring is compressed first, to permit axial movement, and then released for securing the seals or is expanded first, to permit axial movement, and then released for securing the seals. The cross section of the snap ring spring can be varied to include rectangular and circular sections.

Various modifications and variations will no doubt occur to those skilled in the various arts to which this invention pertains. For example, the particular overlap of the control tube with the projectile may be varied from that disclosed herein. Similarly, the particular size and shape of the case halves may be varied from that disclosed herein. These and all other variations which basically rely on the teachings through which this disclosure has advanced the art are properly considered in the scope of this invention.

We claim:

1. A telescoped ammunition round comprising:

a propellant charge means having an axial cavity and supplying firing power for said ammunition round;

a projectile means housed within said cavity for being fired from said ammunition round;

a generally tubular casing means surrounding said propellant charge means and having two longitudinal splits dividing said casing means into two substantially identical halves so as to separate during firing and sustain pressure created by said propellant charge means without deforming; and first and second end cap means for providing a gas seal during firing of said ammunition round in a chamber and for coupling adjacent ends of said halves of said tubular cavity to each other, and first end cap means coupling the two adjacent ends of said halves at the forward end of said projectile means and having a central opening for passing said projectile means when said projectile means is fired, and said second end cap means coupling the two adjacent ends of said halves at the rearward end of said projectile means and cooperates to close off the rear of said telescoped ammunition round with respect to said projectile means.

2. A telescoped ammunition round as recited in claim 1 wherein:

said casing means has end support flanges at each end of said two substantially identical halves so as to facilitate coupling of both of said halves to said first and second end cap means.

3. A telescoped ammunition round as recited in claim 2 wherein:

said first end cap means includes a retainer means having a generally annular shape with a radially outwardly extending retaining flange positioned adjacent the axially interior side of an adjacent one of said end support flanges, having a central opening for passing said projectile means, and having exterior threads; and said first end cap means includes a sealer means having an annular shape with interior threads for engaging the exterior threads of said retainer means and adapted to be positioned adjacent the axially exterior side of an adjacent one of said end support flanges.

4. A telescoped ammunition round as recited in claim 3 wherein:

said sealer means has at least a portion axially outward and radially outward of said case means thereby containing said case means as part of said ammunition round.

5. A telescoped ammunition round as recited in claim 4 wherein:

said sealer means has a generally L-shaped cross section.

6. A telescoped ammunition round as recited in claim 2 wherein:

said first end cap means includes a retainer means having a generally ring shape with a central opening for passing said projectile means and a radially outwardly extending retaining flange positioned adjacent the axially interior side of an adjacent one of said support flanges;

said first end cap means includes a sealer means having a ring shape and positioned adjacent the axially exterior side of an adjacent one of said support flanges; and said retainer means and said sealer means having mating snap fastening means for coupling said retainer means and said sealer means to each other thereby trapping and supporting said casing means therebetween and establishing the dimensions of the length and diameter of said ammunition round.

7. A telescoped ammunition round as recited in claim 6 wherein:

said snap fastening means includes a deflectable snap ring spring means and axially aligned, opposing circular openings in said retainer means and said sealer means for receiving said snap ring spring means so that when said snap ring spring means is deflected into a position of said circular openings there can be relative axial movement between said retainer means and said sealer means and when said snap spring means is undeflected in said circular openings there is interference to relative axial movement between said retainer means and said sealer means.

8. A telescoped ammunition round as recited in claim 7 wherein:

said circular openings are sized so that said snap ring spring means can be compressed into a portion of said circular openings in said retainer means and expands to an undeflected position so that a portion of said snap ring spring means is radially positioned adjacent a portion of said retainer means and a portion of said sealer means.

9. A telescoped ammunition round as recited in claim 2 wherein:

said first end cap means includes a retainer means having a generally ring shape with a central opening for passing said projectile means and a radially outwardly extending retaining flange positioned adjacent the axially interior side of an adjacent one of said support flanges;

said first end cap means includes a sealer means having a ring shape and positioned adjacent the axially exterior side of an adjacent one of said support flanges; and said retainer means and said sealer means having mating swagged fastening means for coupling said retainer means and said sealer means to each other thereby trapping and supporting said casing means therebetween and establishing the dimensions of the length and diameter of said ammunition round.

10. A telescoped ammunition round as recited in claim 9 wherein:

said swagged fastening means includes a radially interior portion of said retainer means bending around a radially interior portion of said sealer means thereby securing said sealer means as said casing means.

* * * * *